US006386995B1

(12) United States Patent
Jastram

(10) Patent No.: US 6,386,995 B1
(45) Date of Patent: May 14, 2002

(54) GOLF BALL POSITION MARKER AND METHOD

(76) Inventor: W. Michael Jastram, 12070 Greenwell Springs Rd., Baton Rouge, LA (US) 70814

( * ) Notice: Subject to any disclaimer, the term of this patent is extended or adjusted under 35 U.S.C. 154(b) by 0 days.

(21) Appl. No.: 09/770,291

(22) Filed: Jan. 29, 2001

(51) Int. Cl.[7] ..... A63B 57/00
(52) U.S. Cl. ..... 473/406
(58) Field of Search ..... 473/406, 285; D21/794

(56) References Cited

U.S. PATENT DOCUMENTS 1,716,261 A 6/1929 Davis
1,735,736 A * 11/1929 Davidson ..... 473/406
3,347,551 A 10/1967 Dreyfus
5,356,133 A * 10/1994 Bellagamba ..... 473/406
5,476,258 A 12/1995 Frisone
5,529,299 A * 6/1996 Bellagamba ..... 473/406
6,017,282 A 1/2000 Stefonsky

* cited by examiner

*Primary Examiner*—Steven Wong
(74) *Attorney, Agent, or Firm*—Merek & Voorhees

(57) ABSTRACT

The present invention is directed to a golf ball position marker and method including a ball position marker having indicia thereon for determining the distance and direction of the original position of the ball on the surface of the putting green. The indicia can be in the form of numbers and arrows or can be simply dots indication the direction and number of clubheads away from the original position of the golf ball on the green. The marker is preferably flat and can have indicia on both the top and the bottom thereof. The indicia on one side may be advertisement. In an alternate embodiment, the marker may be applied as a sticker to another ball marking implement.

14 Claims, 3 Drawing Sheets

GOLF BALL POSITION MARKER AND METHOD

FIELD OF THE INVENTION

The present invention generally relates to the game of golf and more particularly to the marking of golf ball position on the putting green.

BACKGROUND OF THE INVENTION

When playing the game of golf, according to protocol, up to four players, i.e. a foursome, play each hole together. Usually, all players are allowed to reach the green prior to any one of them putting their ball into the cup. Generally, the player whose ball is farthest from the cup is allowed to put first. It often occurs that another player's golf ball is in a position between the putter's ball and the cup such that it is possible that the putter's ball will strike other player's golf ball as it rolls toward the cup. In order to avoid contact between the balls, the spot of the interfering ball will be marked with a marker specifically designed for this purpose or a coin is sometimes used and the interfering ball will be picked up. A problem remains, however, that the marker itself may cause interference with the shot of the putter. In this instance, the marker is moved a measured distance away from the spot of the ball. Measuring is usually accomplished by placing a clubhead next to the spot of the ball and moving the marker to the other end of the clubhead. Sometimes, due to the break of the green, it may be necessary to move the ball marker two, three or even four clubheads away from the spot of the ball to insure that interference with the putter and the putted ball is avoided. The player whose ball was marked and picked up must remember where his ball was located. Ball position markers currently in use fail to indicate the direction and distance to the original location of the ball. Without a reminder of how many clubhead lengths away and which direction, the player may err in replacing his ball either to his favor or detriment. Hence, there exists a significant need for a golf ball position marker and method to facilitate accurate replacement of the ball to its original position which overcomes the substantial and numerous inherent disadvantages of the prior art.

OBJECTS AND SUMMARY OF THE INVENTION

An object of a preferred form of the present invention is to provide a novel and unobvious marker and method for marking a golf ball position on a golf green.

Another object of a preferred form of the present invention is to provide a marker and method for accurately replacing a ball to its prior position on a golf green.

Still another object of the invention is to provide a golf ball position marker having indicia thereon for indicating the direction of the original spot of the ball.

Yet another object of the invention is to provide a golf ball position marker having indicia thereon for indicating the direction and distance away of the original spot of the ball.

A further object of an alternate embodiment of the present invention is to provide adhesive labels for application to golf ball position markers for forming golf ball position markers in accordance with my invention.

Yet another object of the invention is to provide a golf ball position marker which can include a color to remind the golfer that the marker was moved from the ball's original position.

These and other objects of the present invention will be readily apparent upon review of the following detailed description of the invention and the accompanying drawings. These objects of the present invention are not exhaustive and are not to be construed as limiting the scope of the claimed invention.

In summary, a preferred form of the present invention is directed to a golf ball position marker and method including a ball position marker having indicia thereon for determining the distance and direction of the original position of the ball on the surface of the putting green. The indicia can be in the form of numbers and arrows or can be simply dots indicating the direction and number of clubheads away from the original position of the golf ball on the green. The marker is preferably flat and can have indicia on both the top and the bottom thereof. The indicia on one side may be advertisement. In an alternate embodiment, the marker may be applied as a sticker to another ball marking implement. The foregoing summary describes a preferred form and is not in any way to be construed as limiting the claimed invention to the preferred form.

DETAILED DESCRIPTION OF THE INVENTION

Figure 1:
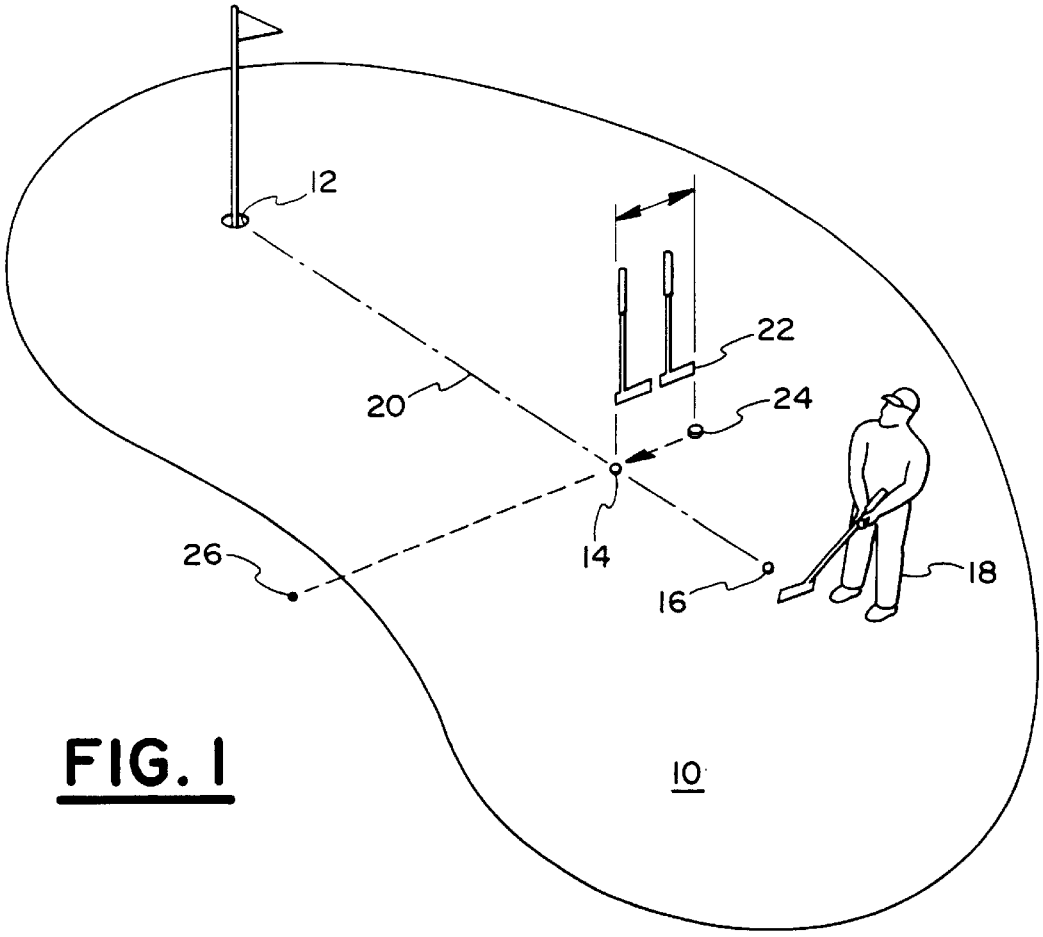
FIG. 1 is a plan view of a golf green illustrating the method of measuring the distance the marker is removed from the original spot of the ball.

The preferred form of the present invention will now be described with reference made to FIGS. 1 to 3. FIG. 1 illustrates a putting green 10 having a cup 12. A first ball 14 is located between the cup 12 and a second ball 16. The second ball 16 is further away from the cup 12 and therefore the player 18 is allowed to put his ball 16 before the first ball 14 is putted. Since the first ball 14 is in the path of the second ball 16, the first ball 14 is moved out of the line of travel 20 of the second ball 16. In order to permit replacement of the first ball 14 to its original position, the distance away from the original position is measured. A clubhead 22 of a golf club 24 is commonly employed for the purpose of measuring the distance. In order to take into account variations in the line of travel of the putt, it is common for a player to move his ball several clubheads away from the original position of the first ball 14. As shown in FIG. 1, the distance being measured is two clubheads away from the original position of the ball 14. The ball position marker 24 is placed at the end of the measured distance. An alignment is made with the marker 24, the first ball 14 and an additional point off the green 10. This third point 26 may be a tree or some other object which will not be moved prior to replacement of the first ball 14 to its original position on the green 10.

Figure 2:
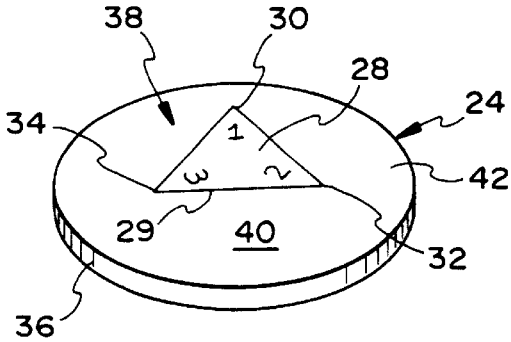
FIG. 2 is a top perspective view of the preferred embodiment of the present invention.

Now looking at FIG. 2, the preferred embodiment of the golf ball position marker 24 of the present invention is shown having a triangle shape 28 on the top surface thereof. The triangle shape 28 provides three angles 30, 32 and 34 which act as arrows or pointers to indicate the direction of the original position of the ball 14. The marker 24 further includes numbers 1, 2 and 3 at each angle 30, 32 and 34 respectively. The numbers indicate the number of clubheads away from the original position of the ball 14 that the marker has been placed. Therefore, when returning the ball 14 to its original position, the player knows how far and in which direction to measure in order to replace the ball 14 in its original position.

For example, to mark the ball 14 of FIG. 1, the distance from the original position to the preferred location of the marker 24 is measured as two club lengths. The marker 24 is placed on the green 10 at the measured distance with the angle 32 pointing toward the original position of the ball 14 and having the numeral 2 for indicating two clubhead lengths away from the original position of ball 14.

Preferably, the marker 24 is manufactured as a substrate 36 having indicia 38 on the top surface 40 thereof. The indicia 38 is preferably painted or stamped onto the surface 40, but may also be molded into the surface 40 of the substrate 36. The indicia 38 is also preferably formed of contrasting colors so that the distance and direction indicators are clearly discernable. For example, the indicia may include a red background 42 surrounding a white triangle 29. The numbers 1, 2 and 3 may then be colored red or some other contrasting color. The marker 24 preferably is in the shape of a flattened disk, but may have various other shapes such as, but not limited to, a triangle or rectangle, which facilitate function or advertising. The marker 24 may be manufactured of any suitable material such as plastic or metal or any other material which will perform the marking function. The thickness of the marker 24 preferably may vary from a few microns to about the thickness of a coin. It is preferred that the thickness not be so great as to interfere with an errant putt or be so large as to be inconvenient for its intended purpose. The diameter of the marker 24 is preferably about one inch, but this should not be construed as a limitation in that as with the thickness, the diameter should be sufficient for the marker's intended purpose, but not be so large as to interfere with a putt or be so large or small that the marker cannot fulfill its intended purpose.

Figure 3:
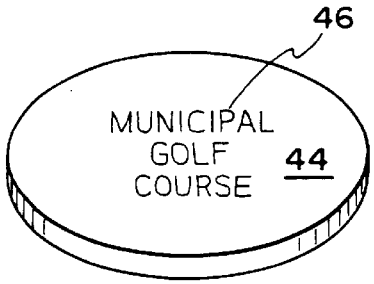
FIG. 3 is a bottom perspective view of the embodiment depicted in FIG. 1.

Now looking at FIG. 3, the bottom surface 44 is shown having indicia 46 thereon. The indicia 46 may include various information such as advertising, golf tips or may be a copy of the indicia 38 on the top surface 40.

Figure 4:
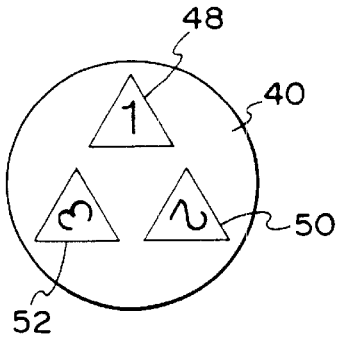
FIG. 4 is a top view of an alternative embodiment of the present invention.
Figure 5:
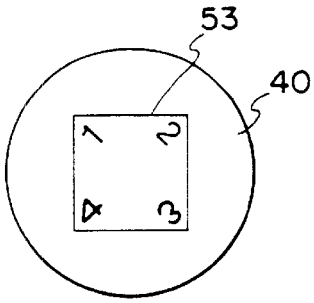
FIG. 5 is a top view of a second alternative embodiment of the present invention.
Figure 6:
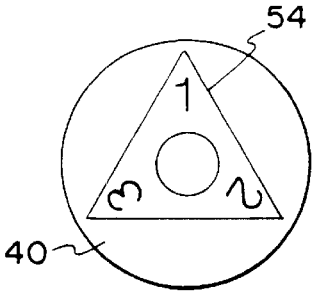
FIG. 6 is a top view of a third alternative embodiment of the present invention.
Figure 7:
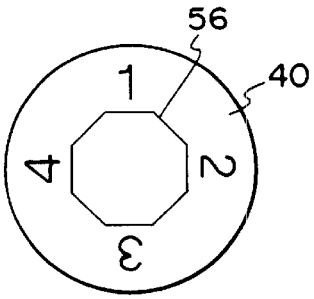
FIG. 7 is a top view of a fourth alternative embodiment of the present invention.
Figure 8:
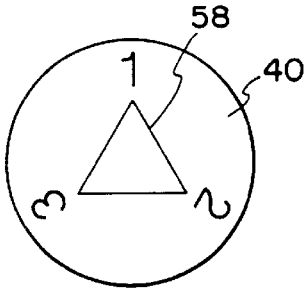
FIG. 8 is a top view of a fifth alternative embodiment of the present invention.
Figure 9:
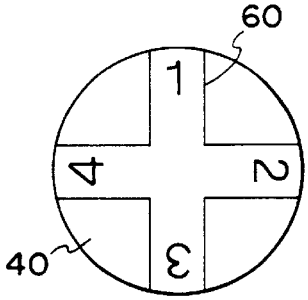
FIG. 9 is a top view of a sixth alternative embodiment of the present invention.
Figure 10:
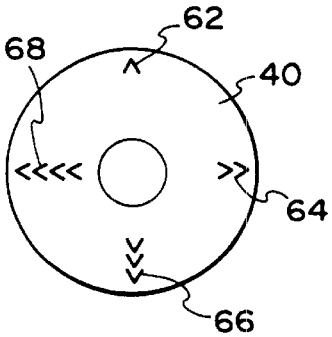
FIG. 10 is a top view of a seventh alternative embodiment of the present invention.
Figure 11:
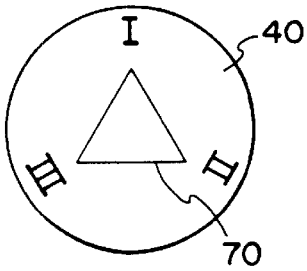
FIG. 11 is a top view of an eighth alternative embodiment of the present invention.
Figure 12:
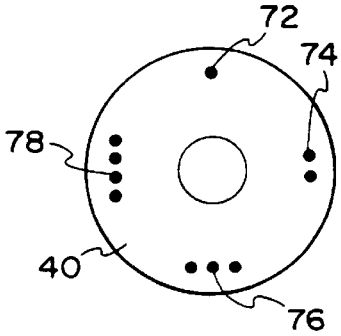
FIG. 12 is a top view of a ninth alternative embodiment of the present invention.

FIGS. 4–12 show alternative embodiments of the present invention. Where like portions of FIG. 3 are shown, like numbers will be used. FIG. 4 shows an arrangement of three triangles 48, 50 and 52 indicating three directions with distance indicated by numerals 1, 2 and 3. FIG. 5 merely uses square 53 having numerals 1, 2, 3 and 4 to indicate both direction and distance. FIG. 6 includes a triangle 54 and numerals 1, 2 and 3 to indicate direction and distance. FIG. 7 uses indicia 56 in the shape of a stop sign and numerals 1, 2, 3 and 4 to indicate both direction and distance. FIG. 8 uses a triangle 58 and numerals 1, 2 and 3 to indicate direction and distance. FIG. 9 includes a cross 60 and numerals 1, 2, 3 and 4 to indicate direction and distance. FIG. 10 uses arrowheads 62, 64, 66 and 68 to indicate direction and distance wherein the number of arrowheads indicates the distance. FIG. 11 uses a triangle 70 and roman numerals I, II and III to indicate direction and distance. FIG. 12 uses dots 72, 74, 76 and 78 to indicate distance and direction. For example, the three dots 76 would indicate three clubhead lengths from the original position of the ball 14 in FIG. 1.

Figure 13:
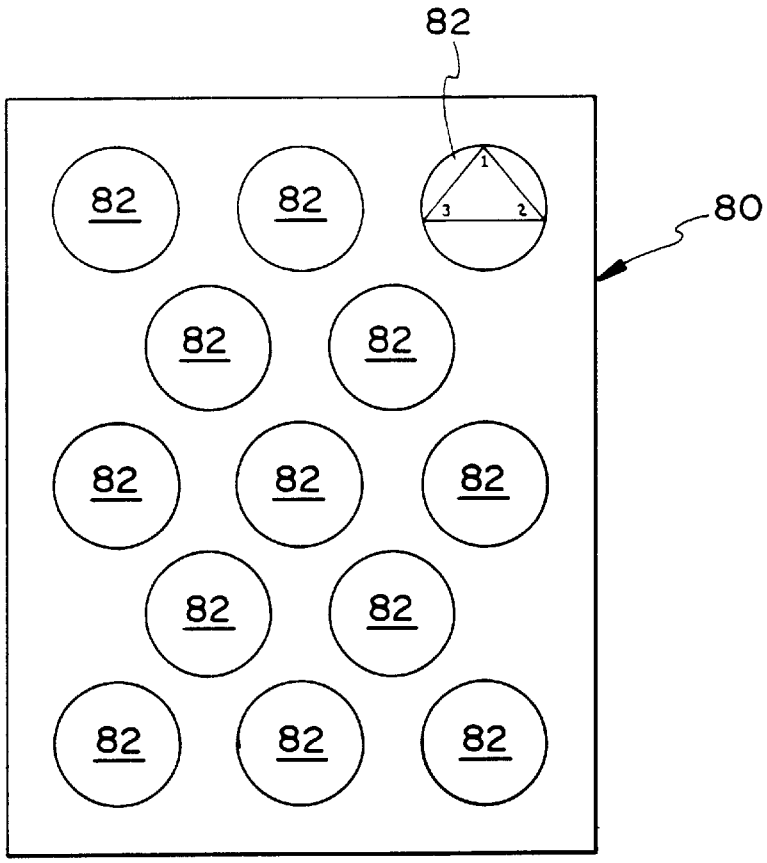
FIG. 13 illustrates a sheet of stickers in accordance with an alternative embodiment of the invention.
Figure 14:
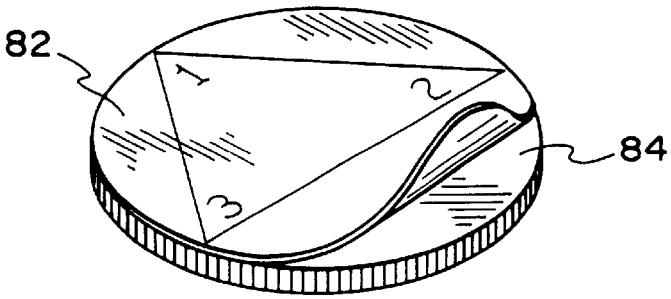
FIG. 14 illustrates t he application of a sticker to a golf ball position marker.

Now referring to FIGS. 13 and 14 an alternative embodiment is shown wherein a sheet 80 includes a plurality of stickers 82 having distance and direction indicia printed or otherwise marked thereon. The stickers 82 are attached to the sheet 80 by releasable adhesive which is known in the art of peel off stickers. In accordance with this embodiment of the invention, one of the stickers 82 is peeled off of sheet 80 and placed upon a suitable substrate such as a coin 84 as shown in FIG. 14. In this way, a ball marker can be formed from any suitable flat object. In addition, the sticker 82 may be placed on a conventional unmarked golf ball position marker (not shown) in order to provide the marker with the advantages of distance and direction indicators.

While this invention has been described as having a preferred design, it is understood that it is capable of further modifications, uses and/or adaptations of the invention following in general the principle of the invention and including such departures from the present disclosure as come within the known or customary practice in the art to which the present Invention pertains and as maybe applied to the central features hereinbefore set forth, and fall within the scope of the invention and the limits of the appended claims.

I claim:

1. A golf ball position marker for indicating the distance and direction to the original location of a ball on the surface of a golf green, comprising:

a) a flat substrate having a top surface and a bottom surface;

b) said top surface having indicia thereon;

c) said indicia on said top surface including reference data indicating distance and direction;

d) said reference data for indicating distance includes data for indicating different distances between said marker and the original position of the ball; and, e) whereby, the original location of a golf ball may be accurately determined by viewing said reference data on said top surface of said golf ball.

2. The golf ball position marker as set forth in claim 1, wherein;

a) said substrate forms a round disk.

3. The golf ball position marker as set forth in claim 1, wherein;

a) said substrate has a thickness of approximately 1/32" to 1/16".

4. The golf ball position marker as set forth in claim 1, wherein;

a) said data for indicating different distances includes a triangle shape having different numerals at each angle whereby each angle is used to indicate a different distance between said marker and the original position of the ball.

5. The golf ball position marker as set forth in claim 1, wherein;

a) said data for indicating different distances includes a plurality of sets of dots spaced about the top surface of said substrate, each of said sets having different amounts of dots at each set whereby each set is used to indicate a different distance between said marker and the original position of the ball.

6. The golf ball position marker as set forth in claim 1, wherein;

a) said indicia is uniformly spaced about said top surface of said substrate.

7. A golf ball position marker for indicating the distance and direction to the original location of a ball on the surface of a golf green, comprising:

a) a flat substrate having a top surface and a bottom surface;

b) said top surface having indicia thereon;

c) said indicia on said top surface including reference data indicating distance and direction;

d) said reference data indicates multiples of a measured distance between said marker and the original position of the ball; and, e) whereby, the original location of a golf ball may be accurately determined by viewing said reference data on said top surface of said golf ball.

8. The golf ball position marker as set forth in claim 7, wherein;

a) said indicia is uniformly spaced about said top surface of said substrate.

9. The golf ball position marker as set forth in claim 7, wherein;

a) said substrate forms a round disk.

10. The golf ball position marker as set forth in claim 7, wherein;

a) said substrate has a thickness of approximately 1/32" to 1/16".

11. The golf ball position marker as set forth in claim 7, wherein;

a) said data for indicating distance includes a triangle shape having different numerals at each angle whereby each angle is used to indicate a different distance between said marker and the original position of the ball.

12. The golf ball position marker as set forth in claim 7, wherein;

a) said data for indicating distance includes a plurality of sets of dots spaced about the top surface of said substrate, each of said sets having different amounts of dots at each set whereby each set is used to indicate a different distance between said marker and the original position of the ball.

13. The golf ball position marker as set forth in claim 7, wherein;

a) said measured distance is one clubhead in length.

14. A golf ball position marking system comprising:

a) a substrate having a top surface and a bottom surface;

b) said top surface having indicia thereon including reference data for indicating distance and direction;

c) said bottom surface having adhesive thereon for attaching said substrate to a golf ball position marker;

d) said reference data for indicating distance includes data for indicating different distances between said marker and the original position of the ball; and, e) whereby, the original location of a golf ball may be accurately determined by viewing said reference data on said top surface of said golf ball.

* * * * *

UNITED STATES PATENT AND TRADEMARK OFFICE

CERTIFICATE OF CORRECTION

PATENT NO. : 6,386,995 B1
APPLICATION NO. : 09/770291
DATED : May 14, 2002
INVENTOR(S) : W. Michael Jastram It is certified that error appears in the above-identified patent and that said Letters Patent is hereby corrected as shown below:

Claim 1, line 52, "...golf ball." should be -- golf ball position marker. --

Claim 7, line 27, "...golf ball." should be -- golf ball position marker. --

Claim 14, line 34, "...golf ball." should be -- golf ball position marker. --

Signed and Sealed this

Second Day of December, 2008

JON W. DUDAS
*Director of the United States Patent and Trademark Office*

UNITED STATES PATENT AND TRADEMARK OFFICE

CERTIFICATE OF CORRECTION

PATENT NO. : 6,386,995 B1
APPLICATION NO. : 09/770291
DATED : May 14, 2002
INVENTOR(S) : W. Michael Jastram It is certified that error appears in the above-identified patent and that said Letters Patent is hereby corrected as shown below:

Column 4, Claim 1, line 52, "...golf ball." should be -- golf ball position marker. --

Column 5, Claim 7, line 27, "...golf ball." should be -- golf ball position marker. --

Column 6, Claim 14, line 34, "...golf ball." should be -- golf ball position marker. --

This certificate supersedes the Certificate of Correction issued December 2, 2008.

Signed and Sealed this

Twentieth Day of January, 2009

JON W. DUDAS
*Director of the United States Patent and Trademark Office*